United States Patent [19]

Fjällström

[11] Patent Number: 4,650,570

[45] Date of Patent: Mar. 17, 1987

[54] STRAINER ASSEMBLY FOR PULP

[75] Inventor: Roland O. A. Fjällström, Lawrenceville, Ga.

[73] Assignee: Celleco A.B., Stockholm, Sweden

[21] Appl. No.: 675,450

[22] Filed: Nov. 28, 1984

[30] Foreign Application Priority Data

Nov. 28, 1983 [SE] Sweden ..... 8306549

[51] Int. Cl.[4] ..... D21D 5/16

[52] U.S. Cl. ..... 209/250; 209/211; 209/270; 162/55

[58] Field of Search ..... 162/55; 209/268, 270, 209/273, 211, 379, 250; 210/354, 402, 403, 404

[56] References Cited

U.S. PATENT DOCUMENTS

| | | | |
|---|---|---|---|
| 721,390 | 2/1903 | Reinicke | 209/273 |
| 1,921,750 | 8/1933 | Heinrich et al. | 209/273 |
| 1,974,651 | 9/1934 | Haug | 209/273 |
| 3,241,676 | 3/1966 | Neuville et al. | 209/270 |
| 4,441,999 | 4/1984 | Frykhult | 210/354 |

FOREIGN PATENT DOCUMENTS 8000361 6/1983 Sweden .

*Primary Examiner*—Steve Alvo
*Attorney, Agent, or Firm*—Cyrus S. Hapgood

[57] ABSTRACT

An assembly for straining of pulp suspensions and the like comprises a strainer drum (1) mounted in a strainer house (2). One or a plurality of devices (5–9) are provided, in order to free impurity particles from fibers, preferably designed like an impact plate, in the strainer house (2) in the flow path, so that the particles in the stream partly are subject to an impact action, and so that the stream is subjected to a variation in velocity.

4 Claims, 6 Drawing Figures

STRAINER ASSEMBLY FOR PULP

The present invention relates to an assembly for straining of pulp suspensions and the like, comprising a strainer drum with a substantially circular cylindrical mantle provided with strainer openings, said drum being arranged in a strainer house, provided with at least one inlet for an incoming first stream of pulp suspension, an outlet for a second stream, which does not pass through the strainer openings, and an outlet for a third stream, which passes the strainer openings.

The object of straining pulp suspensions is to remove impurities, like knots and non-digested fiber bundles etc. from the pulp. Of course it is quite important, from an economical point of view, that the straining is efficient, that is to say that a high degree of separation is achieved, so that as much as possible of the impurities is removed when straining, without loosing to much cellulose together with the impurities in said second stream.

The object of the invention is to provide an assembly of the type mentioned introductorily, which permits an efficient straining with a high degree of separation of impurities, and with a high product yield.

Such an assembly is characterized, according to the invention, by at least one device, provided in the strainer house, partly intended to give solid particles in the first and/or the second stream an impact effect, and partly to provide variations of speed in the first and/or the second stream, in order to facilitate the separation between particles following the second resp. the third stream.

Practical tests have shown that such an assembly, usually including a plurality of devices, has given a surprising improvement of the performance of the strainer.

The device is suitably designed like an impact plate, usually substantially plane, but different embodiments are possible. The device or the devices can be arranged in the inlet for the incoming first stream, or be placed further into the interior of the strainer house. Suitably the first device is arranged, seen from the wall of the strainer house, with the plane of the device forming an angle $\alpha$ against the stream, the angle being in the interval 0° to 90°. The device must not necessarily extend from the wall of the strainer house. Devices could be fixed in other ways in the flow path.

The device can be stationary or adjustable. In the latter case the device can be designed in such a way that the angle $\alpha$ can be set to a desired value. It may also be suitable to arrange a device, adjustable depending on the flow size in such a way that an increasing flow means a minor angle $\alpha$ and thus a larger through flow area for the stream. In this way a constant separation action is achieved by the device, even if the flow varies more or less.

The invention shall now be described more closely, reference being made to the attached drawings, in which FIG. 1 shows a transversal sectional view of an assembly according to the invention;

Figure 1:
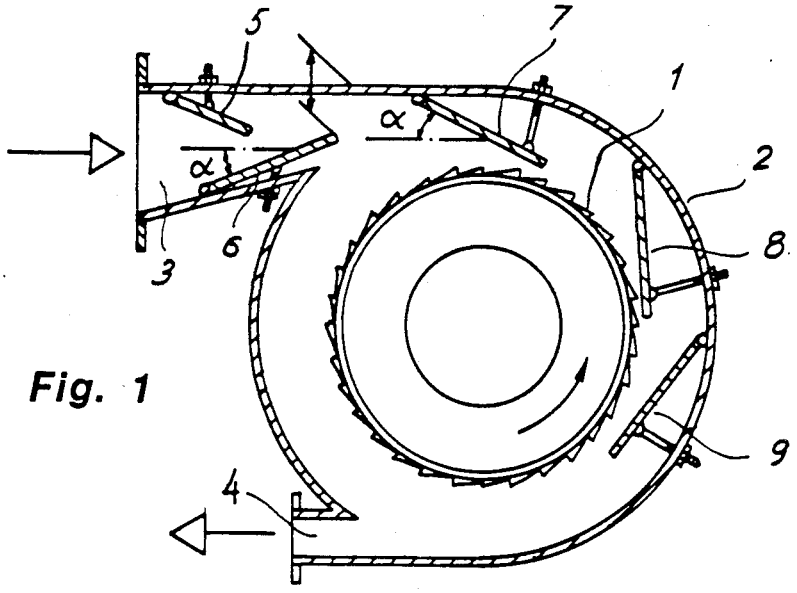

In FIG. 1, 1 is a circular cylindrical strainer drum, mounted rotatable in a strainer house 2. The strainer house is provided with an inlet 3 for an incoming stream and an outlet 4 for a stream, which does not pass through the strainer openings of the strainer drum, which are not shown in detail. There is also an outlet—not shown—in the gable of the strainer drum for the stream, which passes through the strainer openings in the strainer drum. Within the strainer house there are provided a number of devices in the form of impact plates 5, 6, 7, 8 and 9, extending from the wall of the strainer house 2. Two of them, with references 5 and 6, are arranged in the inlet part of the strainer house 2, whilst the other ones are provided in that part of the strainer house 2, which encloses the strainer drum 1. The devices 5 and 6 are thus hit by the incoming stream of pulp, whilst the devices 7, 8 and 9 are hit by a stream, from which in rising degree a partial flow has been discharged, passing the strainer openings. At the devices 6 and 7 the angle $\alpha$ shows the inclination of the pivoted device in relationship to the direction of the incoming stream. All the devices 5–9 shown are stationary.

Figure 4:
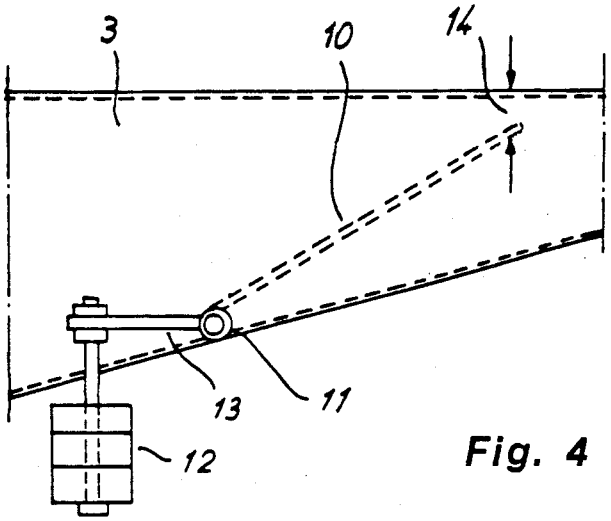
FIGS. 4–6 shows, schematically, three different embodiments of adjustment means for devices according to the invention.
Figure 5:
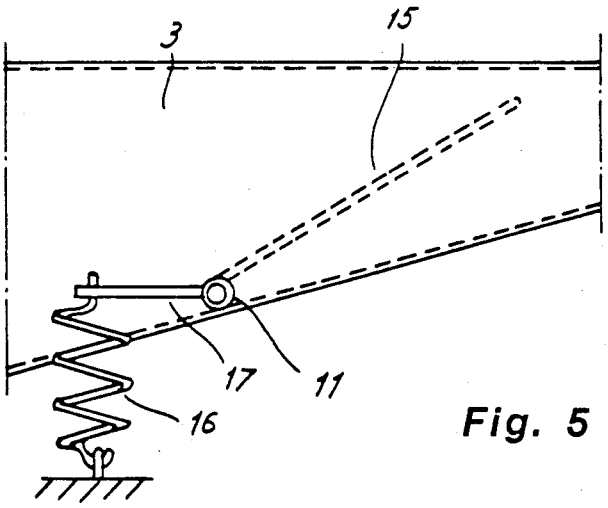
Figure 6:
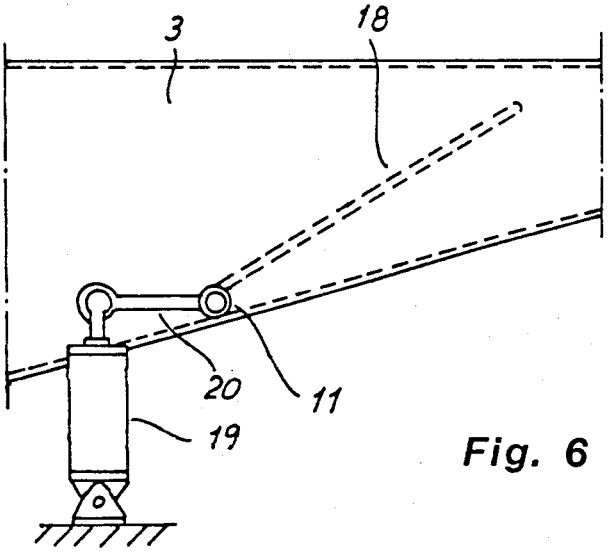

In FIG. 4 there is shown a device 10, provided in the inlet part 3 of the strainer house. The device is pivoted around a shaft 11, and is loaded by weight 12, which aims at turning the device 10 via an arm 13. A minor passing stream means that the through flow area 14 is small, as the weight 12 aims at keeping the device 10 in an upward inclined position. When increasing the stream, the device 10 is pressed downward by the stream, and the weight 12 is lifted upward. In FIG. 5 there is shown an alternative embodiment, where a device 15 is loaded by a spring 16 via an arm 17. One further embodiment is shown in FIG. 6, where a device 18 is acted upon by a pneumatic or hydraulic cylinder 19 via an arm 20. The inclination of the device 18 against the stream can be acted upon by the pressure in the cylinder. A device according to any of FIGS. 4–6 should be used in the inlet part 3 of a strainer house 2. Then the advantage is gained that the inlet velocity of the stream between the device and the strainer wall will be relatively constant.

The assembly according to the invention has proven to be especially advantageous in one embodiment, where the strainer drum is designed according to the Swedish Patent Specification No. 8000651-3, that is to say with inclined impact plates between the strainer openings, which give an outward directed component of movement to a stream, which hits the mantle of the strainer drum, if a strainer drum rotates counter clockwise, as in FIG. 1.

Figure 2:
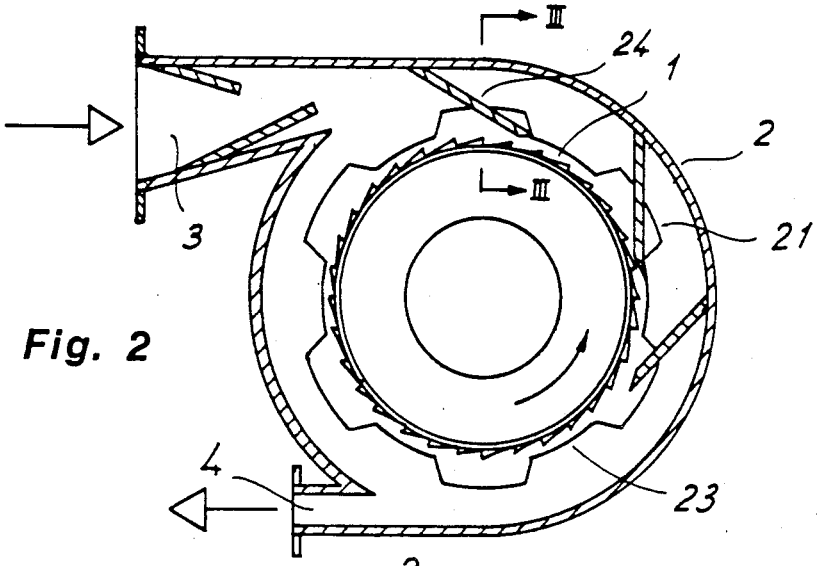
FIG. 2 shows a transversal sectional view through an alternative embodiment.
Figure 3:
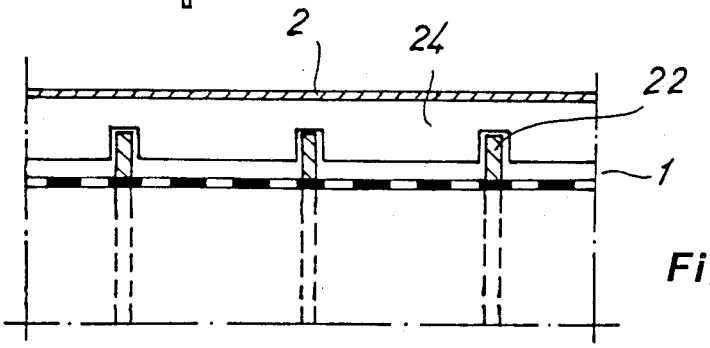
FIG. 3 shows a sectional view along the line III—III in FIG. 2.

One special embodiment of the assembly according to the invention is shown in FIGS. 2 and 3. It has become obvious that it may happen as an exception that fibers spin together to threadlike agglomerates on the mantle of the strainer drum. This disadvantage can be avoided, if an assembly according to the invention is modified according to FIGS. 2 or 3. The strainer drum 1 has been provided with transversal rings 22, which at the circumference are provided with cuts 23. These rings run in cuts in the devices, as is shown in a device 24, so that a sawing or cutting action is provided. The threadlike agglomerates are sawn or cut at the rotation of the strainer drum.

The assembly according to the invention can be used in different applications in pulp straining, that is to say, regular straining and also straining of knots or so called "deflaking".

It will be understood from FIGS. 1 and 2 that a stream of suspension from inlet 3 flows clockwise around strainer drum 1 toward outlet 4 while the drum rotates counterclockwise. During this flow, particles in the stream are subjected to an impact action by the plate-like devices (such as devices 5–9 in FIG. 1), and these devices also subject the stream to variations in velocity. In this way, the devices act to free impurity particles from the fibers in the suspension and facilitate the separation between particles following the second and third streams which flow through outlet 4 and through the strainer openings, respectively. Preferably, the angle $\alpha$ in FIG. 1 is greater than 0° and less than 90°.

It will be apparent that the parts 12–13, 16–17 and 19–20 in FIGS. 4, 5 and 6, respectively, constitute control means responsive to changes in the size of the stream flowing against the device (10, 15 or 18) to reduce the angle $\alpha$ in response to an increase in the stream size, thereby providing a larger throughflow area for the stream.

I claim:

1. In an assembly for straining suspensions of solid pulp particles and including a strainer housing, a strainer drum rotatably mounted in the housing and having a substantially circular cylindrical mantle provided with strainer openings, said housing having an inlet for directing an incoming first stream of said suspension into a region in the housing outside said drum, an outlet for discharging a second stream which does not pass through the strainer openings, and an outlet for discharging a third stream which passes through said openings, said inlet being tangentially directed into the housing, and at least one impact plate member located in the strainer housing in position to subject solid particles in at least one of said first and second streams to an impact effect, thereby facilitating the separation between particles following said second and third streams, respectively, said impact plate member being attached to the housing and at an angle to the flow direction of said one stream, the improvement which comprises a device mounted in said inlet and attached to said housing for pivotal movement about an axis, said device having a plane forming an acute angle with the flow direction of said incoming first stream, and control means connected to said device and responsive to an increase in the flow pressure of said first stream against the plane of the device to reduce said angle, thereby providing a larger through-flow area for said first stream, said control means being responsive to a decrease in said flow pressure to increase said angle and thereby reduce said through-flow area.

2. The improvement of claim 1, in which said control means comprises a weight acting to turn the device around said axis via an arm in a direction which increases said angle.

3. The improvement of claim 1, in which said control means comprises a spring acting to turn the device around said axis via an arm in a direction which increases said angle.

4. The improvement of claim 1, in which said control means comprises a pressurized cylinder acting to turn the device around said axis via an arm in a direction which increases said angle.

* * * * *